US009663119B2

(12) United States Patent
Takahashi et al.

(10) Patent No.: US 9,663,119 B2
(45) Date of Patent: May 30, 2017

(54) RAILROAD VEHICLE AND PLUG DOOR FOR RAILROAD VEHICLE

(71) Applicants: CENTRAL JAPAN RAILWAY COMPANY, Nagoya-shi, Aichi (JP); NIPPON SHARYO, LTD., Nagoya-shi, Aichi (JP); NABTESCO CORPORATION, Chiyoda-ku, Tokyo (JP)

(72) Inventors: Yukio Takahashi, Toyohashi (JP); Hiroki Tsunoda, Atami (JP); Soshi Kawakami, Kawasaki (JP); Yuya Futamura, Nagoya (JP); Tomoyuki Fukunaga, Saitama (JP); Tadahiro Mitsuda, Nagoya (JP); Genta Sakaki, Kobe (JP)

(73) Assignees: CENTRAL JAPAN RAILWAY COMPANY NIPPON SHARYO, LTD., Nagoya (JP); NIPPON SHARYO, LTD., Nagoya (JP); NABTESCO CORPORATION, Tokyo (JP)

( * ) Notice: Subject to any disclaimer, the term of this patent is extended or adjusted under 35 U.S.C. 154(b) by 93 days.

(21) Appl. No.: 14/646,272

(22) PCT Filed: Oct. 31, 2013

(86) PCT No.: PCT/JP2013/079604

§ 371 (c)(1),
(2) Date: May 20, 2015

(87) PCT Pub. No.: WO2014/080735

PCT Pub. Date: May 30, 2014

(65) Prior Publication Data

US 2015/0298710 A1 Oct. 22, 2015

(30) Foreign Application Priority Data

Nov. 21, 2012 (JP) ..... 2012-255744

(51) Int. Cl.
*B61D 19/00* (2006.01)
*B61D 19/02* (2006.01)
(Continued)

(52) U.S. Cl.
CPC ..... *B61D 19/003* (2013.01); *B61D 19/009* (2013.01); *B61D 19/02* (2013.01);
(Continued)

(58) Field of Classification Search
CPC .... B61D 19/00; B61D 19/003; B61D 19/009; B61D 19/02; B61D 19/008; B61D 19/005;
(Continued)

(56) References Cited

U.S. PATENT DOCUMENTS 4,091,570 A 5/1978 Favrel
9,403,540 B2 * 8/2016 Takahashi ..... B61D 19/02

FOREIGN PATENT DOCUMENTS

CN 102303618 A 1/2012
FR 2294306 A1 7/1976
(Continued)

OTHER PUBLICATIONS

Jan. 21, 2014 International Search Report issued in International Patent Application No. PCT/JP2013/079604.
(Continued)

*Primary Examiner* — Mark Le
(74) *Attorney, Agent, or Firm* — Oliff PLC

(57) ABSTRACT

Provided are a railroad vehicle that makes it possible to maintain the air tightness of a door and a plug door for a railroad vehicle. A second rail is provided parallel to a first
(Continued)

rail in the longitudinal direction of a vehicle body above the leading edge side (door side) of a plug rail. The second rail supports the leading edge side of the plug rail. As a result, both edges of the plug rail are supported by the first rail and the second rail. Dangling of the leading edge side of the plug rail is thus prevented even when the plug distance (the distance that the door moves in the vehicle body width direction) is long. In this way, it is possible to block the doorway without leaving a gap using the door and to maintain the air tightness of the door.

6 Claims, 6 Drawing Sheets

(51) Int. Cl.
*E05D 15/10* (2006.01)
*E05F 15/56* (2015.01)

(52) U.S. Cl.
CPC ..... *E05D 15/1042* (2013.01); *E05D 15/1044* (2013.01); *E05F 15/565* (2015.01); *E05D 2015/1028* (2013.01); *E05D 2015/1039* (2013.01); *E05Y 2201/412* (2013.01); *E05Y 2800/12* (2013.01); *E05Y 2900/51* (2013.01)

(58) Field of Classification Search
CPC . E05D 15/10; E05D 15/1042; E05D 15/1044; E05D 2015/1028; E05D 2015/1039; E05D 15/1068; E05D 15/08; E05D 2015/1071; E05D 15/1007; E05D 2015/1078; E05D 2015/1092; E05D 15/1002; E05D 15/20; E05D 15/01; E05F 15/565; E05Y 2201/412; E05Y 2800/12; E05Y 2900/51; E05Y 2800/102
See application file for complete search history.

(56) References Cited

FOREIGN PATENT DOCUMENTS

| | | | | |
|---|---|---|---|---|
| GB | 1439940 | A | | 6/1976 |
| GB | 1477843 | A | | 6/1977 |
| JP | S48-68305 | U | | 8/1973 |
| JP | S61-165872 | U | | 10/1986 |
| JP | H04-41458 | U | | 4/1992 |
| JP | H04-129370 | U | | 11/1992 |
| JP | 2006-7924 | | * | 1/2006 |
| JP | 2006-007924 | A | | 1/2006 |
| JP | 2008-174151 | A | | 7/2008 |

OTHER PUBLICATIONS

Jan. 21, 2014 Written Opinion issued in International Patent Application No. PCT/JP2013/079604.
Mar. 22, 2016 Search Report issued in European Patent Application No. 13856878.7.

* cited by examiner

RAILROAD VEHICLE AND PLUG DOOR FOR RAILROAD VEHICLE

TECHNICAL FIELD

The present invention relates to a railroad vehicle and a plug door for a railroad vehicle, and more particularly, to a railroad vehicle that efficiently moves a door to an airtight position and makes it possible to ensure the air tightness of the door without increasing the size of a cylinder device even when the door must be moved across a distance to arrive at the airtight position, and a plug door for a railroad vehicle.

BACKGROUND ART

Conventional railroad vehicles, particularly high-speed railroad vehicles include ones equipped with a plug door. The plug door has a door form such that the outer surface thereof is flush with the outer surface of a vehicle body when the doorway is closed. This plug door allows reductions in air resistance and noise such as wind noise.

As for such plug door, Patent Literature 1 listed below discloses a plug door device for a vehicle, in which a slide rail 10 extending toward a side wall of a vehicle body is coupled to a guide rail 6 extending in a longitudinal direction of the vehicle body, so as to allow movement along the guide rail 6, and a door 3 is coupled to the slide rail 10 so as to allow movement along the slide rail 10.

CITATION LIST

Patent Literature

Patent Literature 1: JP-A No. 2006-7924

SUMMARY OF INVENTION

Technical Problem

However, in the plug door device for the vehicle disclosed in the above-described Patent Literature 1, the door 3 is coupled in a cantilevered fashion to the guide rail 6 through the slide rail 10. Therefore, there is a problem of, especially when the slide rail 10 is long (when the plug distance is long), the possibility that due to dangling of the leading end side of the slide rail 10, a doorway is not blocked and the air tightness of the door cannot be ensured.

Accordingly, the present invention has been made in order to address the above-described problem, and an object of the present invention is to provide a railroad vehicle that makes it possible to ensure the air tightness of the door, and a plug door for a railroad vehicle.

Solution to Problem and Advantageous Effects of Invention

The railroad vehicle according to claim 1 offers the following advantages. That is, a plug rail for guiding the door in movement in a width direction of a vehicle body extends between a first rail and a second rail. The first rail is suspended from a ceiling of the vehicle body and extends in a longitudinal direction of the vehicle body for guiding the door in reciprocal movement in the vehicle body longitudinal direction with respect to a doorway. The second rail is suspended from the ceiling of the vehicle body between the first rail and a side wall of the vehicle body and extends in the vehicle body longitudinal direction for guiding the door in reciprocal movement in the vehicle body longitudinal direction with respect to the doorway. In this manner, the plug rail is held at both ends by the first rail and the second rail. Thus, dangling of the leading end of the plug rail can be prevented. Therefore, there is the advantage of being able to reliably block the doorway and ensure the air tightness of the door.

The railroad vehicle according to claim 2 offers the following advantage in addition to the advantages of the railroad vehicle according to claim 1. While the door is blocking the doorway, a door hanging member, a moving member, the plug rail, and the second rail are superposed from bottom to top in a sectional side view. Thus, dangling of the plug rail can be prevented even while the door is blocking the doorway. Therefore, there is the advantage of being able to reliably block the doorway and ensure the air tightness of the door.

The railroad vehicle according to claim 3 offers the following advantage in addition to the advantages of the railroad vehicle according to claim 1 or 2. That is, when the door is closed, the door is pressed by a second pressing device prior to being pressed by a first pressing device. The second pressing device is disposed to face an inner surface of the door and adapted to press the door toward a door frame. When a second piston is extended in the vehicle body width direction, a pressing member coupled to a leading end of the second piston abuts on the inner surface of the door and presses the door toward the door frame. Thus, the door is moved toward the door frame. In this manner, the second pressing device extends the second piston perpendicularly with respect to the inner surface of the door, and therefore it is possible to efficiently move the door toward the door frame.

Thereafter, the door is pressed by the first pressing device. The first pressing device is disposed adjacent to the door in the vehicle body longitudinal direction and adapted to press the door toward the door frame. When a first piston is extended in the vehicle body longitudinal direction, a link mechanism operates and abuts on the inner surface of the door to press the door toward the door frame. In this manner, the first pressing device presses the door through the link mechanism, and therefore, even if an external force is applied from an outer surface of the door, not all external forces act on the piston. It is therefore possible to resist the external force and maintain the air tightness of the door without increasing the size of the piston. Consequently, there are the advantages of efficiently moving the door to an airtight position and making it possible to ensure the air tightness of the door without increasing the size of the cylinder device even when the door must be moved across a distance to arrive at the airtight position.

A plug door for a railroad vehicle according to claim 4 offers the advantage of being able to reliably block the doorway and ensure the air tightness of the door.

DESCRIPTION OF EMBODIMENT

Figure 1:
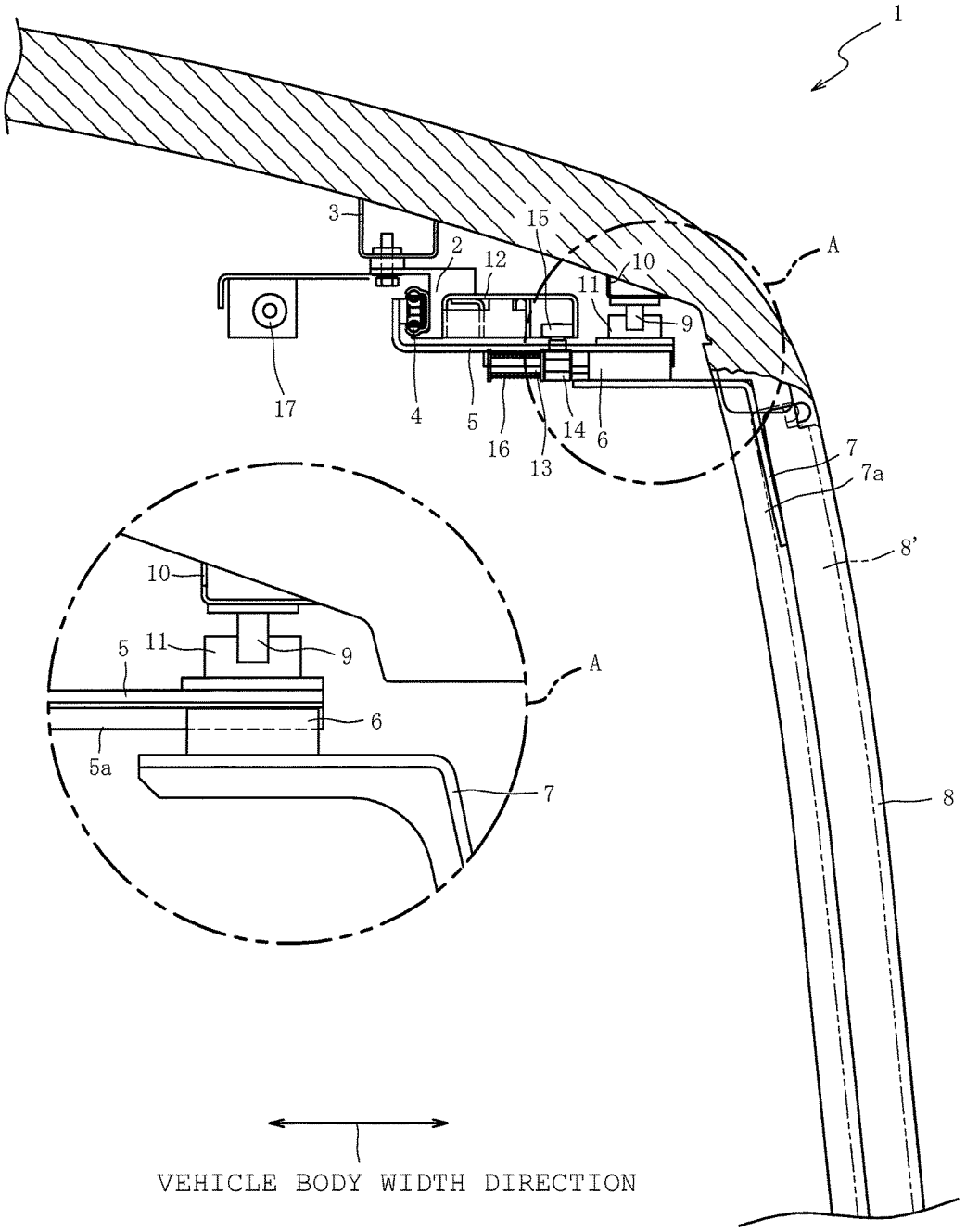
FIG. 1 is a sectional side view of a railroad vehicle.
Figure 2:
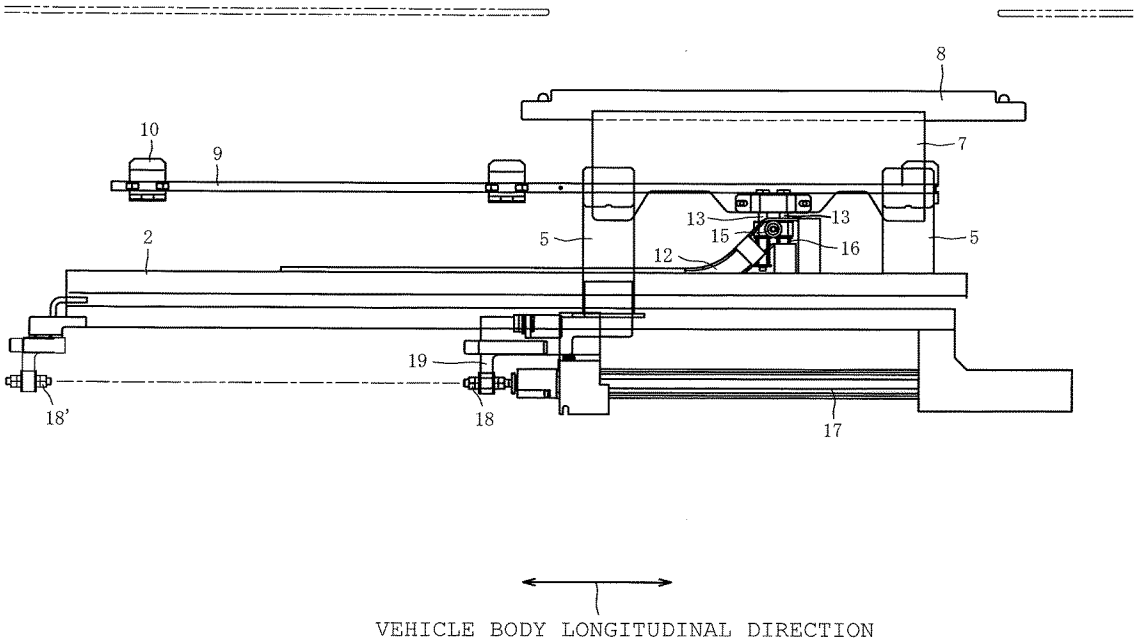
FIG. 2 is a plan view of the railroad vehicle.
Figure 3:
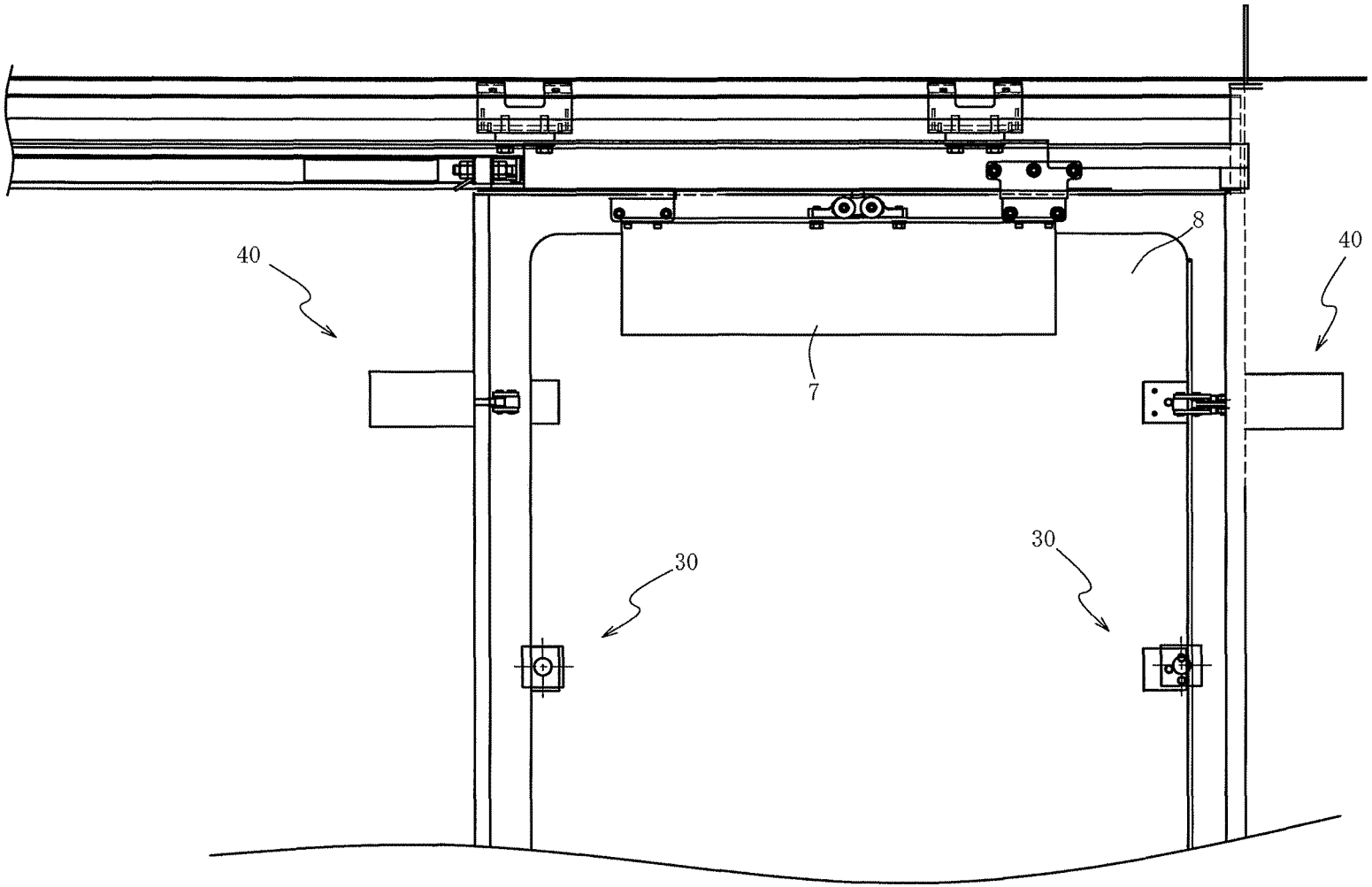
FIG. 3 is a front view of the railroad vehicle.

Hereinafter, a preferred embodiment of the present invention will be described with reference to the accompanying drawings. FIG. 1 is a sectional side view of a railroad vehicle 1; FIG. 2 is a plan view of the railroad vehicle 1; and FIG. 3 is a front view of the railroad vehicle 1.

The railroad vehicle 1 is provided with a first rail 2 extending in a vehicle body longitudinal direction (i.e., from the near side to the far side of the drawing sheet in FIG. 1). The first rail 2 is fixed through a U-shaped hanging fitting 3 that is fixed to a frame (not shown) in a ceiling. A bearing fitting 4 abuts on one surface (the left side surface in FIG. 1) of the first rail 2. The bearing fitting 4 moves in the vehicle body longitudinal direction along the one surface of the first rail 2. An L-shaped plug rail 5 is coupled to the bearing fitting 4.

The plug rail 5 extends downwardly from the bearing fitting 4 and then is bent to extend toward a door 8. A rail 5*a* (see Portion A in FIG. 1) is formed on an extended end of the plug rail 5, and a moving member 6 is provided at the rail 5*a* so as to be movable in a vehicle body width direction (i.e., in the horizontal direction in FIG. 1).

An L-shaped door-hanging fitting 7 is coupled to a lower surface of the moving member 6 so as to couple the moving member 6 and the door 8. The door 8 is provided integral with the moving member 6 through the door hanging fitting 7 so as to be movable in the vehicle body width direction (i.e., in the horizontal direction in FIG. 1). The door 8 is adapted to open and close a doorway of the railroad vehicle 1.

A second rail 9 is provided parallel to the first rail 2 in the vehicle longitudinal direction above the leading end side (door 8 side) of the plug rail 5 (see FIG. 2). The second rail 9 supports the leading end side (door 8 side) of the plug rail 5. As a result, both ends of the plug rail 5 are supported by the first rail 2 and the second rail 9. Dangling of the leading end side of the plug rail 5 can be thus prevented even when the plug distance (the distance that the door 8 moves in the vehicle body width direction) is long. That is, dangling of the door 8 coupled to the plug rail 5 through the door hanging fitting 7 can be prevented. It is therefore possible to block the doorway without leaving a gap using the door 8 and to ensure the air tightness of the door 8.

Furthermore, as shown in FIG. 1, the second rail 9 is fixed through an L-shaped hanging fitting 10 that is fixed to the frame (not shown) in the ceiling. A block piece 11 is configured to be movable in the vehicle body longitudinal direction along the second rail 9.

Furthermore, a guide passage 12 is coupled to the other surface (the right side surface in FIG. 1) of the first rail 2. guide passage 12 is the passage through which a rotating roller 15 to be described later passes, and, as shown in FIG. 2, composed of a straight passage along the first rail 2 and a bent passage that is bent toward the center of the gateway from one end of the straight passage.

As shown in FIG. 2, two shafts 13 are coupled between the plug rails 5 at a central portion of the door hanging fitting 7. A slide member 14 is inserted on the two shafts 13. A rotary shaft is erected on the upper surface of the slide member 14, and the rotating roller 15 is rotatably provided on the rotary shaft.

Furthermore, a coil spring 16 is inserted on each of the two shafts 13 on the opposite side across the slide member 14 from the door 8 so as to urge the slide member 14 toward the door 8. Thus, the rotating roller 15 travels while separating the door 8 from the wall surface when passing through the inside of the guide passage 12, and can also move smoothly from the straight passage to the bent passage of the guide passage 12.

Further, as shown in FIG. 2, inside the first rail 2 (on the lower side in FIG. 2), there are provided an air cylinder 17 and a rod 18 that telescopes in parallel with the first rail 2 from the air cylinder 17. The rod 18 can telescope from its position shown in FIG. 2 to the position indicated by a rod 18'. The rod 18 is also coupled to the bearing fitting 4 through a coupling fitting 19.

Therefore, the telescopic motion of the rod 18 allows the bearing fitting 4, the plug rail 5 coupled to the bearing fitting 4, the moving member 6 coupled to the plug rail 5, the door hanging fitting 7, the door 8, and the block piece 11 to reciprocate in the vehicle body longitudinal direction. It should be noted that the shafts 13, the slide member 14, and the rotating roller 15 are also allowed to reciprocate in the vehicle body longitudinal direction through the door hanging fitting 7.

In contrast, as shown in FIG. 1, the door 8 cannot be moved beyond the position of a door 8' indicated by the two-dot dash line in FIG. 1, simply by the telescopic motion of the rod 18. That is, it is an auxiliary pressing device 30 and a main pressing device 40 to be described later that move the moving member 6 in the vehicle body width direction along the rail 5*a* of the plug rail 5 and move the door 8 to the position of the door 8 indicated by the solid line in FIG. 1.

As shown in FIG. 3, the auxiliary pressing device 30 and the main pressing device 40 are arranged around the door 8. The auxiliary pressing device 30 is a pressing device that is disposed to face the inner surface of the door 8 and presses the door 8 toward the door frame. The main pressing device 40 is a pressing device that is disposed adjacent to the door 8 in the vehicle body longitudinal direction and presses the door 8 toward the door frame. To close the door 8, the auxiliary pressing device 30 is brought into operation first, and then the main pressing device 40 is brought into operation.

It should be noted that, in FIG. 3, a pair of left and right main pressing devices 40 on the same level is shown on the upper side, and below them, a pair of left and right auxiliary pressing devices 30 on the same level is shown. However, actually, a pair of left and right main pressing devices 40 on the same level is provided below the auxiliary pressing devices 30, and below them, a pair of left and right auxiliary pressing devices 30 on the same level is provided, and further below them, a pair of left and right main pressing devices 40 on the same level is provided.

That is, the three main pressing devices 40 and the two auxiliary pressing devices 30 are alternately provided on the left side. Also in the same manner, the three main pressing devices 40 and the two auxiliary pressing devices 30 are alternately provided on the right side. Thus, it is possible to equally press the door 8 against the door frame and to ensure the air tightness.

Next, referring to FIGS. 4 to 6, the auxiliary pressing device 30 and the main pressing device 40 for pressing the door 8 against the door frame will be described in concrete terms.

Figure 4B:
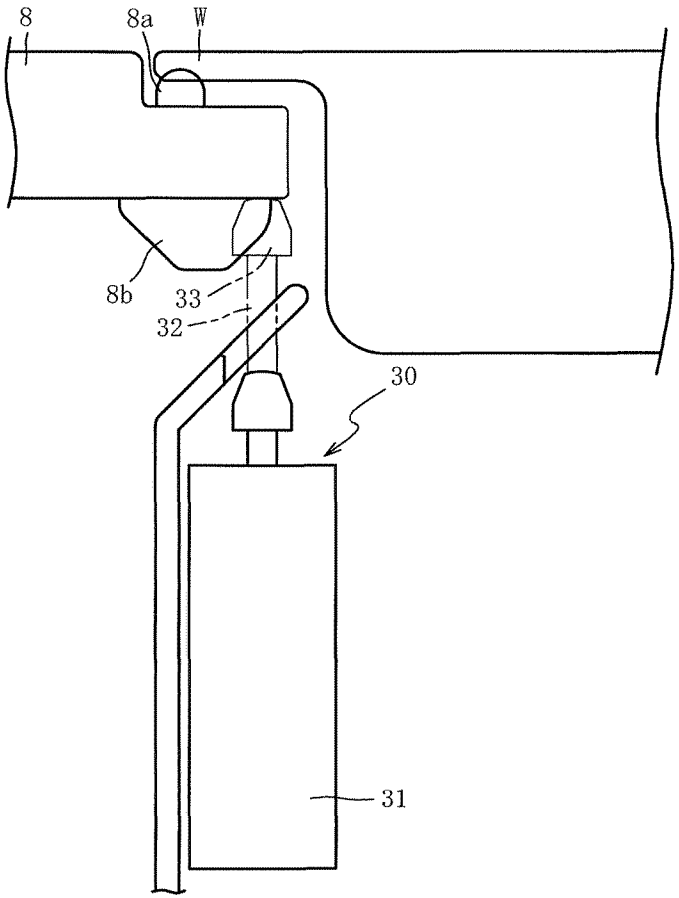
FIG. 4(*a*) is a schematic diagram showing a state in which an auxiliary pressing device is unoperated, and FIG. 4(*b*) is a schematic diagram showing a state in which the auxiliary pressing device is in operation.
Figure 4A:
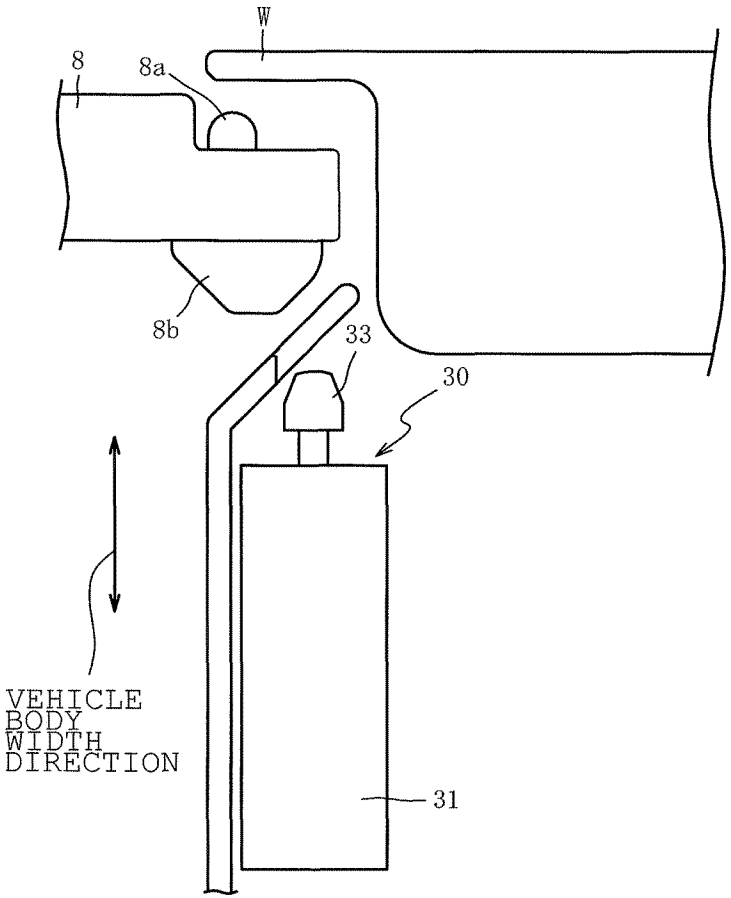

FIG. 4(*a*) is a schematic diagram showing a state in which the auxiliary pressing device is unoperated, and FIG. 4(*b*) is a schematic diagram showing a state in which the auxiliary pressing device is in operation. It should be noted that FIG. 4 shows the schematic diagram on the door end side of the door 8.

The auxiliary pressing device 30 is adapted to further move the door 8' indicated by the two-dot dash line in FIG. 1 toward the doorway and press the door 8 against a door frame W. The auxiliary pressing device 30 is provided inside an in-vehicle wall extending in the vehicle body width direction and fixed to a frame of the wall. The auxiliary pressing device 30 is composed of an air cylinder 31, a piston 32 (FIG. 4(*b*)) that telescopes in the vehicle body width direction from the air cylinder 31, and a pressing member 33 that is coupled to a leading end of the piston 32 and abuts on the inner surface of the door 8 to press the door 8.

When the door 8 is moved to the position 8' indicated by the two-dot dash line in FIG. 1, the piston 32 is extended in the vehicle width direction to cause the pressing member 33 to abut on the inner surface of the door 8 so as to move the door 8 toward the door frame W (in the vehicle body width direction). It should be noted that the door 8 is provided with a rubber airtight cap 8*a*, and the air tightness of the door 8 can be ensured by pressing the airtight cap 8*a* against the door frame W. Furthermore, the auxiliary pressing device 30 causes the piston 32 to abut perpendicularly on the inner surface of the door 8, thereby allowing efficient movement and press of the door 8.

Moreover, a blocking wall 8*b* that surrounds the portion of the door 8 on which the pressing member 33 abuts is provided inward the vehicle on an inner surface (on the door end side) of the door 8. Thus, an accident, such as pinching a finger between the pressing member 33 and the inner surface of the door 8, can be prevented. It should be noted that a gap between the leading end of the blocking wall 8*b* and the obliquely-extending wall surface is of a size so that the finger does not enter the gap.

Figure 5A:
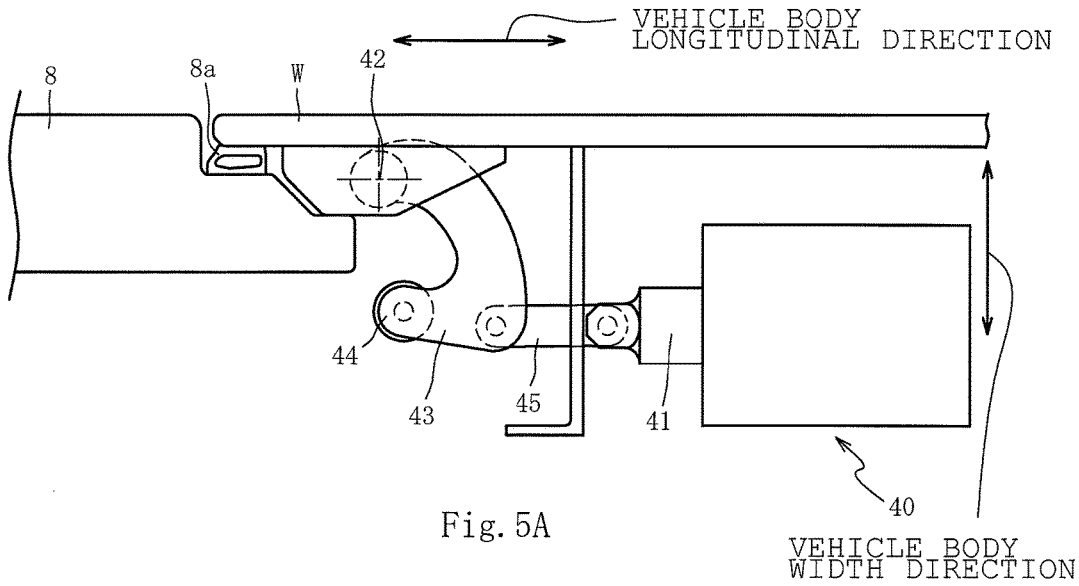
FIG. 5(*a*) is a schematic diagram showing a state in which a main pressing device is unoperated, and FIG. 5(*b*) is a schematic diagram showing a state in which the main pressing device is in operation.
Figure 5B:
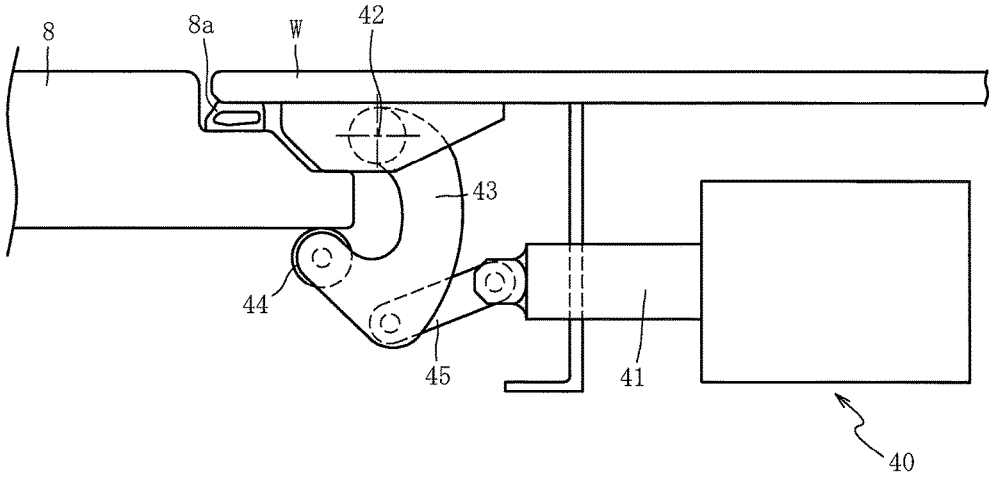

FIG. 5(*a*) is a schematic diagram showing a state in which the main pressing device is unoperated, and FIG. 5(*b*) is a schematic diagram showing a state in which the main pressing device is in operation. The main pressing device 40 is adapted to further press the door 8 moved to the position shown in FIG. 4(*b*) by the auxiliary pressing device 30 against the door frame W. The main pressing device 40 is provided inside a vehicle side wall and fixed to a frame of the vehicle side wall.

The main pressing device 40 is provided with an air cylinder 41 and a piston that telescopes in the vehicle body longitudinal direction from the air cylinder 41. The main pressing device 40 is also provided with: a rotary shaft 42 coupled to the inner surface of the vehicle body side wall and extending vertically; an arm 43 journaled to the rotary shaft 42 and extending inward the vehicle, a leading end thereof being bent toward the inner surface of the door 8; a rotating roller 44 turnably journaled to the leading end of the arm 43; and a link member 45 having one end that is rotatably coupled to the leading end of the piston and the other end that is rotatably coupled to the arm 43. It should be noted that the leading end of the piston is provided with a rotary shaft and the one end of the link member 45 is coupled to the rotary shaft. Furthermore, the arm 43 is mounted to the rotating roller 44 and the link member 45 in such a manner as to be rotatable on the rotary shaft.

With the main pressing device 40, when the piston is extended in the vehicle body longitudinal direction, the link member 45 causes the arm 43 to rotate about the rotary shaft 42, and the rotating roller 44 turnably journaled to the leading end of the arm 43 abuts the inner surface of the door 8 and presses the door 8 toward the door frame W. In this case, even if an external force is applied from the outer surface of the door 8, the external force is distributed without acting directly upon the link member 45 and the piston. It is therefore possible to resist the external force and ensure or maintain the air tightness of the door 8 without increasing the size of the cylinder 41.

That is, if the main pressing device 40 and the auxiliary pressing device 30 are operated in reverse order, the main pressing device 40 cannot move the door 8 over a long distance. In order to move the door 8 over a long distance, it is necessary to increase the size of the arm 43, and, accordingly, also to increase the size of the cylinder 41. Furthermore, it is necessary to increase the size of the cylinder 31, because the external force acts directly upon the piston 32 in the auxiliary pressing device 30.

As described above, causing the main pressing device 40 and the auxiliary pressing device 30 to work in reverse order leads to an increase in the size of the cylinder device. However, according to the aspect of this embodiment, there is no need to increase the size of the cylinder device. In this manner, according to this embodiment, it is possible to efficiently move the door 8 to an airtight position and ensure or maintain the air tightness of the door 8 without increasing the size of the cylinder device even when the door 8 must be moved across a distance to arrive at the airtight position.

Figure 6A:
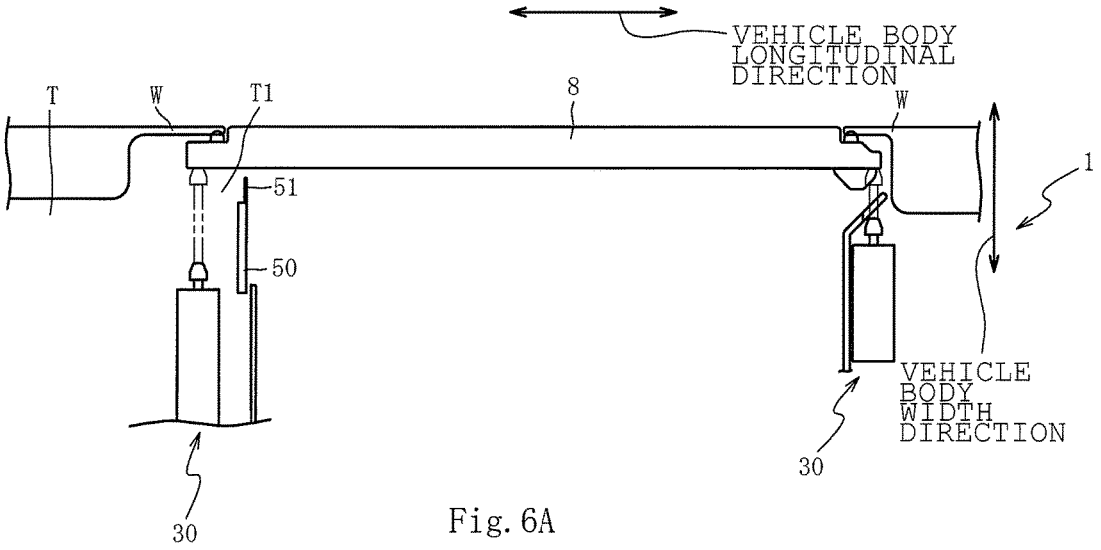
FIG. 6(*a*) is a schematic diagram showing a state in which a door is pressed by the auxiliary pressing devices, FIG. 6(*b*) is a schematic diagram showing a state at the time of storing the door in a door pocket, and FIG. 6(*c*) is a schematic diagram showing a state at the time of removing the door from the door pocket.
Figure 6B:
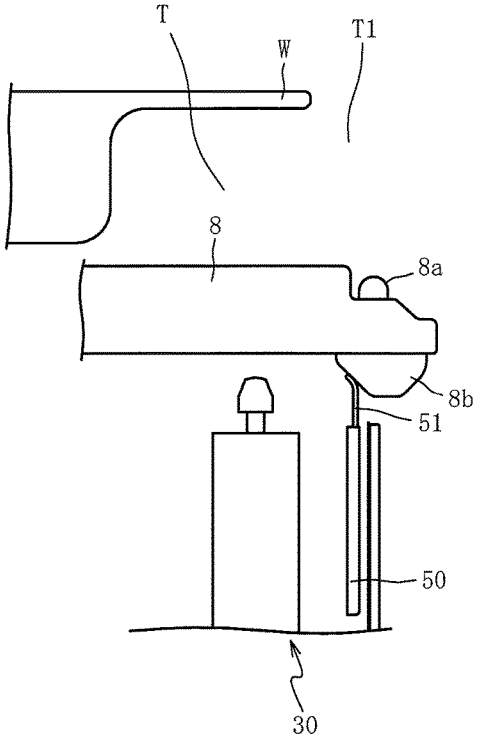
Figure 6C:
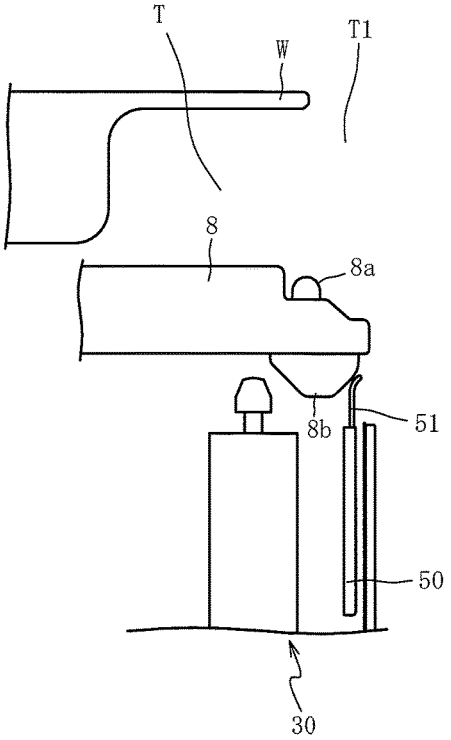

FIG. 6(*a*) is a schematic diagram showing a state in which the door is pressed by the auxiliary pressing devices, (b) is a schematic diagram showing a state at the time of storing the door in a door pocket, and (c) is a schematic diagram showing a state at the time of removing the door from the door pocket.

As shown in FIG. 6(*a*), the railroad vehicle 1 is provided with a door pocket T that stores the door 8 when the door 8 is opened toward the door tail (to the left side in FIG. 6) of the door 8. An opening/closing door 50 for opening and closing an entrance T1 of the door pocket T is also provided. Therefore, when the door 8 is closed (at timing before the auxiliary pressing device 30 is brought into operation), the opening/closing door 50 is moved toward the door 8 so as to close the entrance T1 of the door pocket T. Thus, it is possible to prevent a finger from being inserted through the entrance T1 of the door pocket T and pinched by the auxiliary pressing device 30 or the main pressing device 40.

In contrast, when the door 8 is stored in the door pocket T as shown in FIG. 6(*b*) or when the door 8 is removed from the door pocket T as shown in FIG. 6(*c*), the blocking wall 8*b* provided in a protruding manner on the door 8 abuts on a leading end 51 of the opening/closing door 50.

Therefore, in this embodiment, the portion of the leading end 51 of the opening/closing door 50 through which the blocking wall 8*b* passes is made of rubber or a brush. Thus, even if the blocking wall 8*b* is provided in a protruding manner on the door 8, the entrance T1 of the door pocket T can be covered. It is therefore possible to prevent, for example, the inadvertent entry of a finger from the portion through which the blocking wall 8*b* passes.

While an embodiment of the present invention has been described above, the present invention is by no means limited to the above embodiment, and it is obvious that various modifications may be made without departing from the scope of the present invention.

The invention claimed is:

1. A railroad vehicle provided with a side wall of a vehicle body, a doorway opened in the side wall of the vehicle body, a door that opens and closes the doorway, and a plug mechanism that moves the door to a position where an outer surface of the door is flush with an outer surface of the vehicle body when the doorway is closed by the door, comprising:

wherein the plug mechanism is provided with:

a first rail that is suspended from a ceiling of the vehicle body and extends in a longitudinal direction of the vehicle body, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway;

a plug rail that extends between the first rail and the second rail, the plug rail guiding the door in movement in a width direction of the vehicle body;

a moving member that moves along the plug rail; and a door hanging member coupled to a lower surface of the moving member and to an upper inside surface of the door, wherein the plug rail is provided with a rail formed so as to extend having a dimension longer, in a vehicle width direction, than the moving member, and wherein the moving member is moved along the rail of the plug rail, in the vehicle width direction.

2. The railroad vehicle according to claim 1, wherein, while the door is blocking the doorway, the door hanging member, the moving member, the plug rail, and the second rail are superposed from bottom to top in a sectional side view.

3. The railroad vehicle according to claim 1, further comprising:

a first pressing device that is disposed adjacent to the door in a longitudinal direction of the vehicle body and adapted to press the door toward the outside of the vehicle, the first pressing device having a first piston and a link mechanism, the first piston telescoping in the vehicle body longitudinal direction, and the link mechanism abutting on an inner surface of the door with the telescopic motion of the first piston and rotationally moving the door in a direction to press the door toward the outside of the vehicle and in the reverse direction thereof; and a second pressing device that is disposed to face the inner surface of the door and adapted to press the door toward the outside of the vehicle, the second pressing device having a second piston and a pressing member, the second piston telescoping in a width direction of the vehicle body, and the pressing member being coupled to a leading end of the second piston, the pressing member abutting on the inner surface of the door with the telescopic motion of the second piston and moving the door in a direction to press the door toward the outside of the vehicle and in the reverse direction thereof, wherein, when the door is closed, the door is pressed by the second pressing device prior to being pressed by the first pressing device.

4. A plug door for a railroad vehicle provided with a door that opens and closes a doorway opened in a side wall of a vehicle body of the railroad vehicle and a plug mechanism that moves the door to a position where an outer surface of the door is flush with an outer surface of the vehicle body when the doorway is closed by the door, wherein the plug mechanism is provided with:

a first rail that is suspended from a ceiling of the vehicle body and extends in a longitudinal direction of the vehicle body, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway;

a plug rail that extends between the first rail and the second rail, the plug rail guiding the door in movement in a width direction of the vehicle body;

a moving member that moves along the plug rail; and a door hanging member coupled to a lower surface of the moving member and to an upper inside surface of the door, wherein the plug rail is provided with a rail formed so as to extend having a dimension longer, in a vehicle width direction, than the moving member, and wherein the moving member is moved along the rail of the plug rail, in the vehicle width direction.

5. The railroad vehicle according to claim 2, further comprising:

a first pressing device that is disposed adjacent to the door in a longitudinal direction of the vehicle body and adapted to press the door toward the outside of the vehicle, the first pressing device having a first piston and a link mechanism, the first piston telescoping in the vehicle body longitudinal direction, and the link mechanism abutting on an inner surface of the door with the telescopic motion of the first piston and rotationally moving the door in a direction to press the door toward the outside of the vehicle and in the reverse direction thereof; and a second pressing device that is disposed to face the inner surface of the door and adapted to press the door toward the outside of the vehicle, the second pressing device having a second piston and a pressing member, the second piston telescoping in a width direction of the vehicle body, and the pressing member being coupled to a leading end of the second piston, the pressing member abutting on the inner surface of the door with the telescopic motion of the second piston and moving the door in a direction to press the door toward the outside of the vehicle and in the reverse direction thereof, wherein, when the door is closed, the door is pressed by the second pressing device prior to being pressed by the first pressing device.

6. A plug mechanism that moves a door to a position where an outer surface of the door is flush with an outer surface of a vehicle body when a doorway in a side wall of the vehicle body is closed by the door, the plug mechanism comprising:

a first rail that is suspended from a ceiling of the vehicle body and extends in a longitudinal direction of the vehicle body, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway;

a plug rail that extends between the first rail and the second rail, the plug rail guiding the door in movement in a width direction of the vehicle body;

a moving member that moves along the plug rail; and a door hanging member coupled to a lower surface of the moving member and to an upper inside surface of the door, wherein the plug rail is provided with a rail formed so as to extend having a dimension longer, in a vehicle width direction, than the moving member, and wherein the moving member is moved along the rail of the plug rail, in the vehicle width direction.

* * * * *